US009464632B2

(12) United States Patent
Morselli

(10) Patent No.: US 9,464,632 B2
(45) Date of Patent: Oct. 11, 2016

(54) DOUBLE-HELICAL GEAR ROTARY POSITIVE DISPLACEMENT PUMP

(75) Inventor: Mario Antonio Morselli, Modena (IT)

(73) Assignee: SETTIMA MECCANICA S.R.L., Piacenza (IT)

( * ) Notice: Subject to any disclaimer, the term of this patent is extended or adjusted under 35 U.S.C. 154(b) by 0 days.

(21) Appl. No.: 14/232,373

(22) PCT Filed: Jul. 19, 2012

(86) PCT No.: PCT/IT2012/000224
§ 371 (c)(1),
(2), (4) Date: Jan. 13, 2014

(87) PCT Pub. No.: WO2013/011535
PCT Pub. Date: Jan. 24, 2013

(65) Prior Publication Data

US 2014/0212316 A1 Jul. 31, 2014

(30) Foreign Application Priority Data

Jul. 19, 2011 (IT) ..... RM2011A0378

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/16*** | (2006.01) |
| ***F04C 15/00*** | (2006.01) |
| ***F04C 18/16*** | (2006.01) |

(52) U.S. Cl.
CPC ..... *F04C 2/16* (2013.01); *F04C 15/0026* (2013.01); *F04C 18/16* (2013.01)

(58) Field of Classification Search
CPC ..... F04C 2/16; F04C 2/088; F04C 2/101; F04C 18/16; F04C 15/0026; F01C 21/0863
USPC ..... 418/79, 202, 201.1, 201.3, 206.1, 206.5
See application file for complete search history.

(56) References Cited

U.S. PATENT DOCUMENTS

| | | | | |
|---|---|---|---|---|
| 1,719,639 | A * | 7/1929 | Wilsey | 418/169 |
| 2,319,374 | A | 5/1943 | Ungar | |
| 2,611,323 | A * | 9/1952 | Digney | 418/202 |
| 5,092,751 | A * | 3/1992 | Viktora | 418/201.3 |

(Continued)

FOREIGN PATENT DOCUMENTS

| | | |
|---|---|---|
| DE | 11 04 262 | 4/1961 |
| GB | 119 130 | 9/1918 |

(Continued)

OTHER PUBLICATIONS

International Search Report for PCT/IT2012/000224, mailed Nov. 5, 2013.

*Primary Examiner* — Theresa Trieu
(74) *Attorney, Agent, or Firm* — Nixon & Vanderhye P.C.

(57) ABSTRACT

The invention relates to a double-helical gear rotary positive displacement pump including a pump housing rotatably supporting at least a driving shaft and at least a driven shaft, at least a first toothing and a second toothing being associated to the driving shaft and at least a third toothing and a fourth toothing being associated to the driven shaft. The toothings have individually a helical profile that allows their mutual herringbone meshing. Three of toothings are rigidly connected to their respective shafts. The fourth toothing, or other suitable one, is idle on the shaft and axially constrained.

9 Claims, 4 Drawing Sheets

(56) References Cited

U.S. PATENT DOCUMENTS

| | | | | |
|---|---|---|---|---|
| 5,415,041 | A * | 5/1995 | Foran et al. | 73/261 |
| 6,769,891 | B2 * | 8/2004 | Morselli | 418/206.5 |
| 2010/0104463 | A1 * | 4/2010 | Morselli | 418/206.1 |

FOREIGN PATENT DOCUMENTS

| | | | | |
|---|---|---|---|---|
| GB | 559 729 | | 3/1944 | |
| JP | 58053689 | A * | 3/1983 | F04C 2/16 |
| JP | 63124801 | A * | 5/1988 | 418/202 |

* cited by examiner

DOUBLE-HELICAL GEAR ROTARY POSITIVE DISPLACEMENT PUMP

This application is the U.S. national phase of International Application No. PCT/IT2012/000224 filed 19 Jul. 2012 which designated the U.S. and claims priority to IT RM2011A000378 filed 19 Jul. 2011, the entire contents of each of which are hereby incorporated by reference.

TECHNICAL FIELD

The present invention relates to a double-helical gear rotary positive displacement pump.

BACKGROUND ART

As known, rotary positive displacement pumps are used, above all, in hydraulic field, in order to transfer energy to a fluid designed to operate a facility.

Such pumps comprise a casing provided with a suction port and a discharge port, at least a pair of shafts having rotary meshing toothings being housed inside the casing. A plurality of chambers are defined among the meshing teeth by virtue of the rotation, the volume of the chambers varying in the meshing zone so that the fluid is caused to be transferred from the suction side to the delivery side.

The toothed wheels of the positive displacement pumps are usually comprised of straight tooth spur gears that are not expensive.

Thanks to their simple construction, such toothed wheels are very cheap indeed. However, such pumps are subject to drawbacks as they do not deliver the fluid in a constant way due to the straight tooth spur gears, and further they make much noise. These drawbacks depend on that the meshing engages the teeth with a discontinuity typical of a discrete variation (for example, there are one to two meshing teeth when the transverse contact ratio $\epsilon\alpha<2$, and two to three meshing teeth for $2<\epsilon\alpha<3$). This discontinuity causes both mechanical and hydraulic noise. The mechanical noise results from the discontinuity of the meshing mode, and the hydraulic noise depends mainly on that the fluid is transferred in a non-constant way due to distinctive ripples that also cause vibrations in the plant served by the pump. Further, the pumps having both straight tooth gears and involute (but also cycloid) standard helical tooth gears have a problem of a closed space between the tooth bottom land of a toothing, and the tooth top land of a conjugate toothing. This closed space changes during the meshing so that sharp pressure variations in the fluid are provoked. Such a drawback is reduced by means of suitable escape passageways made on side shims or support faces.

Furthermore a reduction of the drawbacks is obtained by means of more valuable helical toothing, in which the contact occurs gradually and with gradually varying lengths along skew lines with respect to the rotation axes. The overlapping of the different contact lines during the meshing makes these toothing very soft in their operation so that an irregular delivery is lessened. The problem of hydraulic irregularity and that one of the trapped fluid are completely overcome by means of so called "continuous contact" special helical profiles having rounded tooth top and bottom. Such profiles by virtue of their specific shape characterised, among other, by the absence of sharp edges, do not encapsulate fluid between the tooth top and the bottom of the conjugate tooth so that the trapped fluid problem is eliminated and the discontinuity of fluid delivery is almost annulled thanks to a suitable choice of the helical contact ratio.

Such profiles are made functional and industrially suitable in applications for high pressures according to teachings of the patents EP1132618, EP1371848 and BO2009A000714 of the present inventor; the last one of these patents is a development of the two preceding patents, and defines so called semi-incapsulating profiles. However, the implementation of these profiles does not solve the problem caused by axial forces resulting from the helical toothings, problem that is overcome by adopting those profiles but in the scope of the present invention, since in the known pumps the use of helical profiles causes axial forces of both mechanical and hydraulic nature. These axial forces, as they can not be completely adjusted, cause an inevitable worsening of the side faces of the toothings and of the support bushings. Further mechanical losses by friction occur with a consequence of reduction of the mechanical efficiency. These drawbacks can be overcome by adopting even more precious double-helical toothings. The double-helical profile allows the axial force resulting from the use of the single helical profile to be balanced, as the two helical profiles are identical and a mirror image of each other with respect to a center line plane of the toothing perpendicular to the axes of rotation.

Also these pumps are not free from drawbacks such as the production cost which is very onerous due to the high level of accuracy requested. Further, this accuracy can be achieved only by means of sophisticated machine tools, as, for example, the gear-cutting machine Sykes that uses a fly cutter but usually does not allow hardened material to be machined. As known, double-helical gears can be obtained through traditional gear-cutting machines and then ground by a technology adapted to high superficial hardness materials. Such gears have a double-helical toothing divided by a toothing free undercutting channel that is generally symmetrical to the center line plane of the profiles and causes heavy inefficiency in liquid sealing. In double-helical toothing it should be suitable from the economical and technological points of view to use simple helical wheels having side by side assembled specular helicals. A main drawback of such a solution consists of the high accuracy requested in relative and absolute positioning of the helical wheel, as each wheel must be in phase with the flanked one and both wheels must be in phase with the conjugate wheels. Also specularity planes of the toothings must be coincident. This implies a first restraint defined by the need of putting in phase the adjacent driving toothing, a second restraint defined by the need of putting in phase the adjacent driven toothing, a third restraint defined by the need of coincidence of the specularity planes, and a fourth restraint represented by the coplanarity of the side faces of the wheels, since they must seal on the side planes of the support bushings or the housing. From said drawbacks it results that the double-helical pumps are difficult to be made and unsatisfactory in their performance: at the same level of accuracy they are less performing at high pressures and generally noisier than the others.

In short and schematically, the drawbacks of the known gear positive displacement pumps are at least the following ones:

A—mechanical noise

B—hydraulic noise and vibrations caused by ripples

C—hydraulic noise and vibrations caused by variations in pressure of the trapped fluid D—axial forces that can not be completely balanced in the helical pumps E—low efficiency of continuous contact helical profile pumps F—too many restraints and construction problems of the double-helical pumps.

In particular, the straight tooth gear pumps have the drawbacks as to preceding items A, B, and C.

The involute helical toothing pumps solve the problem as to item A, they reduce the problem as to item B, they worsen the problem as to item C and further have the problem as to item D.

The continuous contact helical profile pumps solve the problem as to item A, they solve the problem as to item B, they solve the problem as to item C, they solve the problem as to item D but they do not solve the problem as to item E, so that they can not be used for high pressures.

The helical toothing pumps with profiles such as the ones described in the already cited patents EP1132618, EP1371848, and BO2009A000714 solve the problem as to item A, they solve the problem as to item B, they solve the problem as to item C, they have the problem as to item D and they solve the problem as to item E.

The involute double-helical pumps solve theoretically but often not practically the problem as to item A, as, if they are not manufactured and assembled with extreme accuracy, they mesh incorrectly, they reduce the problem as to item B, they do not solve the problem as to item C, they solve the problem as to item D, they do not have the problem as to item E, but they suffer the problem as to item F.

SUMMARY OF THE INVENTION

An object of the present invention is to manufacture a double-helical gear rotary positive displacement pump that eliminates, also completely, the above mentioned specific drawbacks as well as reduces manufacture restraints and simplifies the assembling phases.

In particular the involute double-helical pumps according to the present invention solve the problem as to item A, they reduce the problem as to item B, they do not solve the problem as to item C, they solve the problem as to item D and also they solve the problem as to item F.

The not encapsulating "continuous contact" helical profile pumps made according to the present invention solve the problem as to item A, they solve the problem as to item B, they solve the problem as to item C, they have the problem as to item D, they do not solve the problem as to item E, they solve the problem as to item F.

By adopting the profiles as described in the cited patents EP1132618, EP1371848, and BO2009A000714, the double-helical pump according to the present invention solve practically all the problems described as well as the problem as to item E and thus it is adapted to high pressures.

BRIEF DESCRIPTION OF THE DRAWINGS

Further characteristics and advantages result will become more evident by the following description of preferred embodiments, which are illustrated by way of example not limiting the scope of the present invention, with reference to the accompanying drawing sheets in which.

BEST MODE FOR CARRYING OUT THE INVENTION

Figure 1:
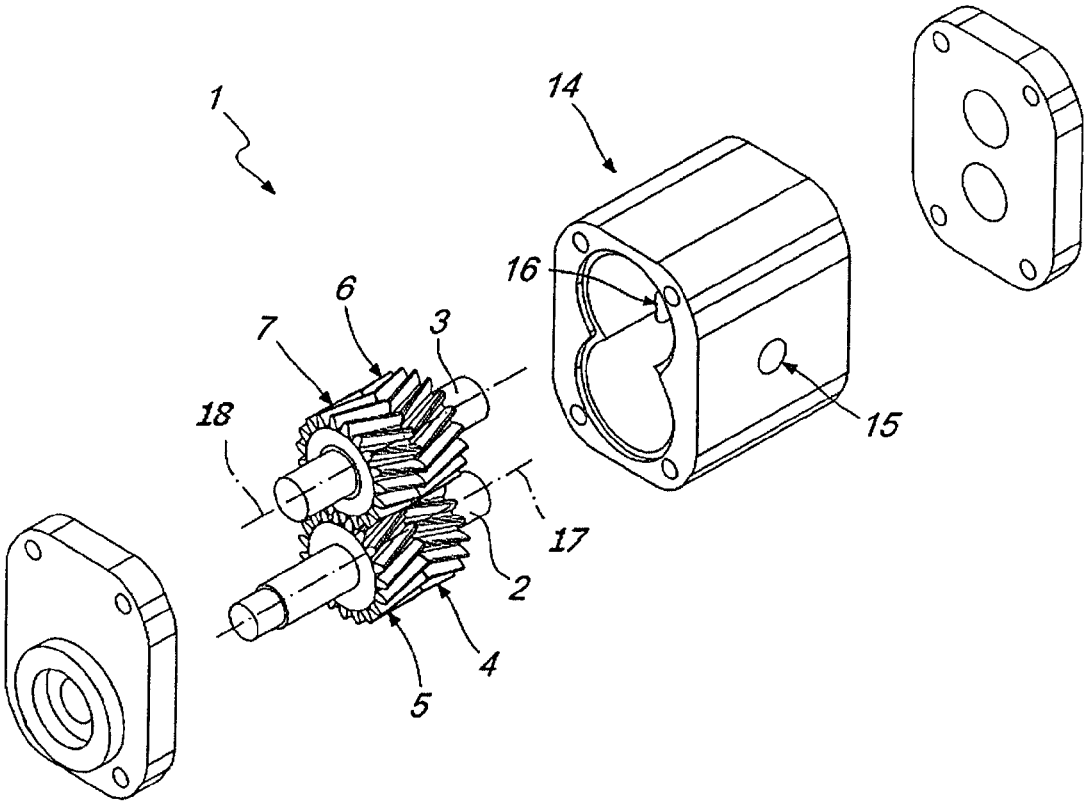
FIG. 1 is a diagrammatic exploded perspective view of a double-helical external gear pumps, according to a feasible combination of fittings.
Figure 2:
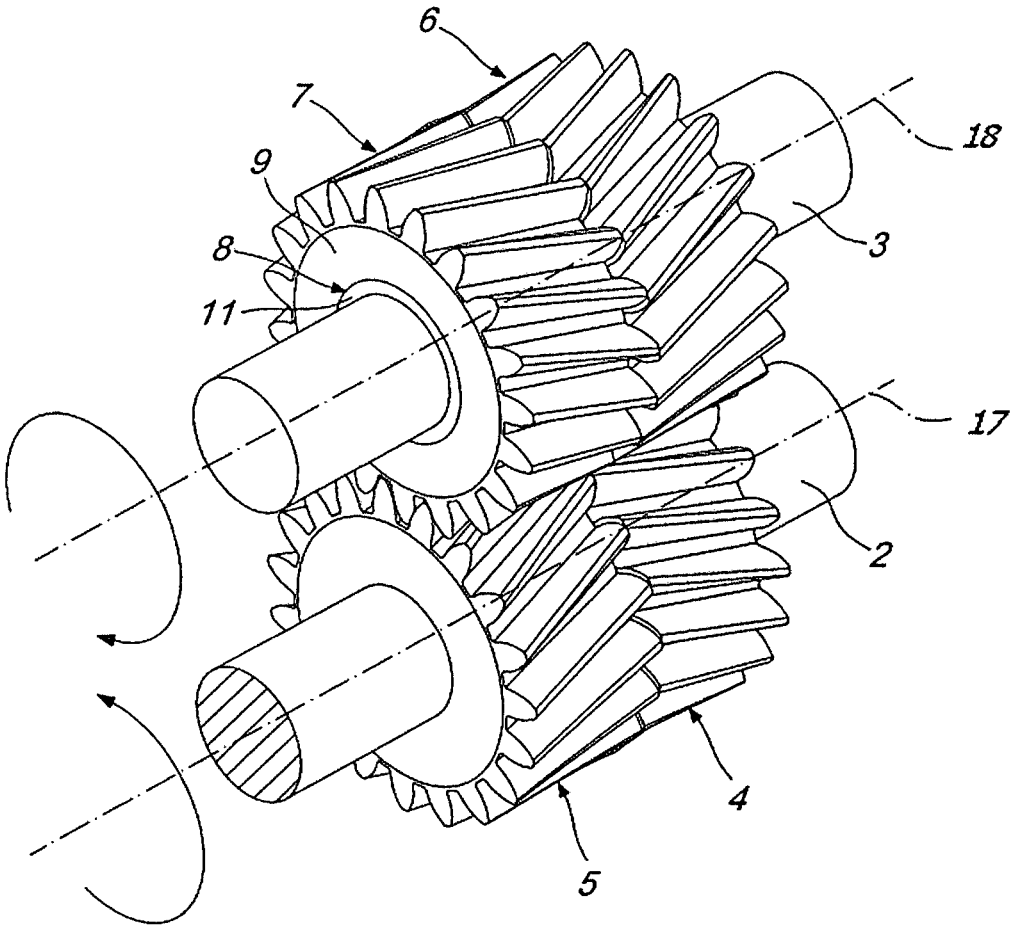
FIG. 2 is a fragmentary enlarged perspective view of the double-helical gear of the pump illustrated in FIG. 1.

With reference to the said figures, the external double-helical toothing rotary positive displacement pump, generally indicated as 1, comprises a housing 14 rotatably supporting inside at least a driving shaft 2 and at least a driven shaft 3.

The driving shaft 2 is associated to at least a first toothing 4, and at least a second toothing 5 and the driven shaft 3 is associated to at least a third toothing 6, and at least a fourth toothing 7, the toothings 4,5,6,7 being helical.

The toothings 4, 5, and 6, 7 on respective shafts 2,3 are adjacent to each other and with the herringbone helical teeth, for transferring the fluid from the suction port 15 to the delivery port 16, that are juxtaposed in this case.

The first toothing 4 and the second toothing 5 are positioned on the driving shaft 2, at least one of them being rigidly connected to the last one. According to the invention, the third toothing 6 and the fourth toothing 7 are positioned on the driven shaft 3, at least one of them being rigidly connected to the last one.

Only one of the four toothings is coupled idle on its shaft, since laterally there is at least an axial constraining element 8 preventing the idle toothing to be removed.

The configurations of the driven shaft and the driving shaft can be changed.

In FIG. 1 the toothing 7 is not rigidly connected to the driven shaft 3 but it is idle and can freely rotate on the same also through interposed rotating means.

The constraining element 8 comprises at least a projection 11 in order to prevent the axial shifting of the idle toothing with respect to the driven shaft 3.

The wheel of the fourth toothing 7 has a first face 9 and a second face 10 that are opposite to each other and lie on parallel planes at right angles to the axis of rotation 18. The two faces 9, 10 are adjacent to the constraining element 8 and to the wheel of the third toothing 6 respectively so that the shifting of the wheel of the fourth toothing 7 is prevented.

Figure 3:
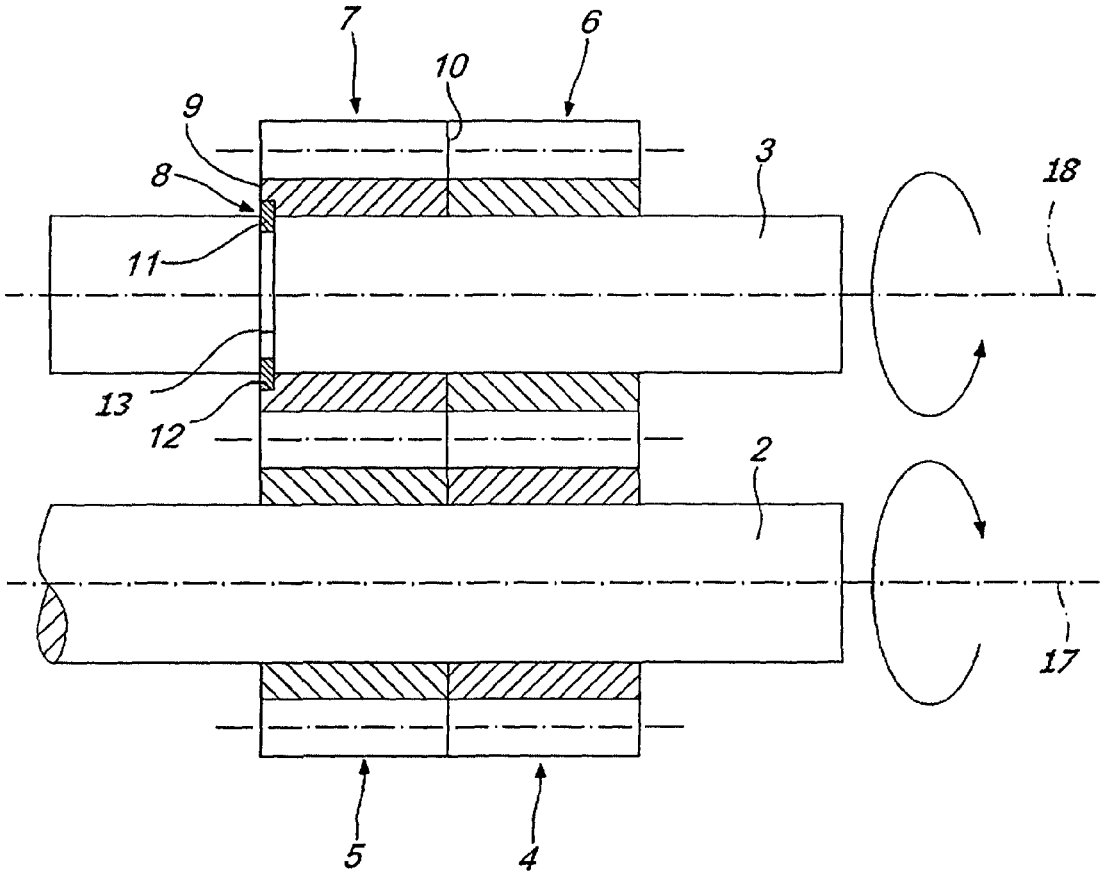
FIG. 3 is a diagrammatic cross-section view in an orthogonal projection of the external double-helical gear in FIG. 2, through a plane containing the axes of rotation.

The side face 9 of the wheel facing outside of the meshing has a circular crown internally limited by the recessed surface 12, said circular crown being plane and perpendicular to the axes of rotation and radially extending in the tooth profile to constitute a sealing element, this plane portion of the side face 9 having to be coplanar to that one of the conjugate toothing. For this purpose the wheel of the fourth toothing 7 has on its side face 9 a notch 13 comprising the recessed surface 12, and adapted to contain the projection 11 in said recessed surface 12, which is not requested to be cylindrical, indicated in FIG. 3. Alternatively this notch can be formed also on the opposite side support, either in the case said support is directly obtained in the housing 14 or it is made in support, truing and skewing bushings interposed among housing and shafts, said bushing being not indicated in FIG. 1.

It is necessary for the liquid sealing that the boundary line of the notch 13 does not intersect the line defining the toothing.

When rotating, the driving shaft 2 moves the driven shaft 3 through the meshing of the first toothing 4 with the third toothing 6.

Consequently, the fourth toothing 7, being idle, becomes automatically in phase with the second toothing 5, by meshing the latter; this allows a restraint in both the manufacture and the operation to be eliminated with a resulting easy assembly. This is achieved as the input is transmitted from the toothings to the liquid and not from the driving shaft to the driven shaft. The input on the driving toothing is transmitted therefrom partially to the liquid and partially to the driven toothing, that, if the frictions are neglected, transmits integrally the power received to the liquid.

In this way when the first toothing 4 meshes the third toothing 6 and the second toothing 5 meshes the fourth toothing 7 the operating liquid is transferred from the suction side 15 to the delivery side 16.

The liquid is transferred by filling and emptying chambers that are formed in the time among the teeth of the wheels, the torque necessary to transfer the liquid being defined on the wheel and not on the shaft. The only torque transmitted by the driving shaft 2 to the driven shaft 3 is that one necessary to overcome the neglectable friction forces of the support means in the rotation of the driven shaft 3 through the toothing 4 and 6 meshing each other.

The double-helical rotary positive displacement pump, according to the present invention, besides balancing the axial forces inside the pump, allows to reduce to a minimum the manufacture and operation bonds simplifying also the assembly phases.

More in particular, the first toothing 4 and the second toothing 5 can be mutually in phase also roughly, however enough accurately for performing the hydraulic work of the pump; the third toothing 6 and the fourth toothing 7 have no restraint in rotation except their meshing.

The pump according to the invention is not subject to quick wear or abnormal noise since the rotating elements are disposed correctly without interfering with each other.

A further advantage of the pump according to the present invention is due to the use of double-helical gears comprising separated helical wheels that are manufactured more accurately and cheaper with respect to the state or art.

The use of continuous contact profiles in the double-helical positive displacement pump has been proved as advantageous: among these profiles the profiles described in the already cited patents of the same inventor are particularly adapted to the use for high pressures.

The double-helical rotary positive displacement pump according to the invention is liable to many changes and modifications all of them being inside the same inventive concept.

Figure 4:
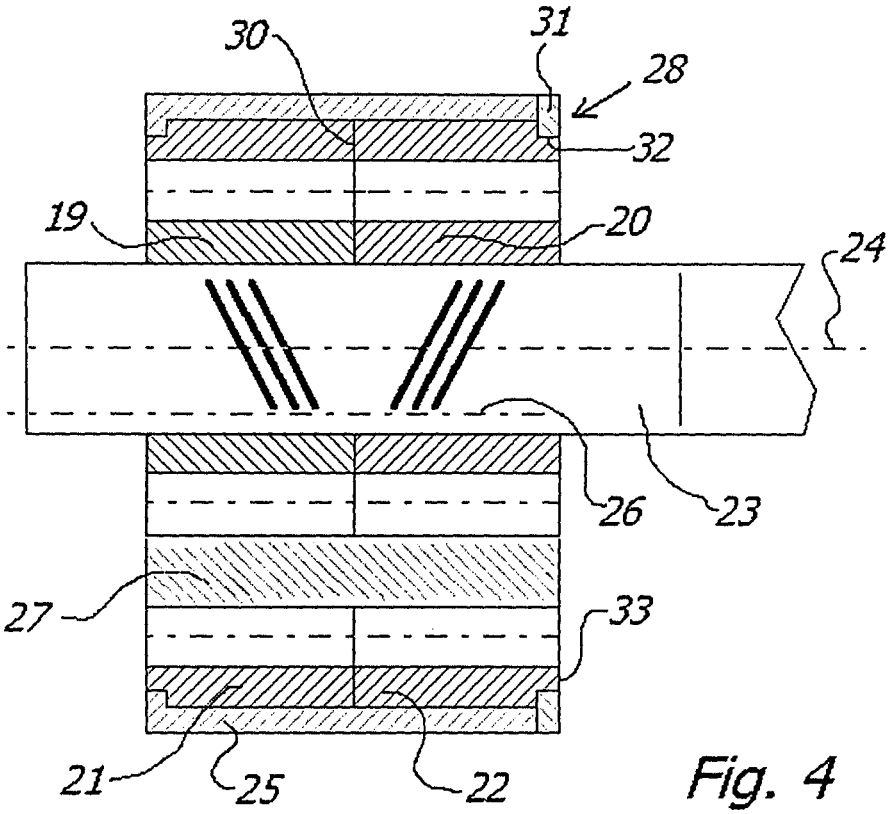
FIG. 4 is a diagrammatic cross-section view, through the plane containing the axes of rotation of the internal double-helical gear of a rotary positive displacement pump according to the present invention.
Figure 5:
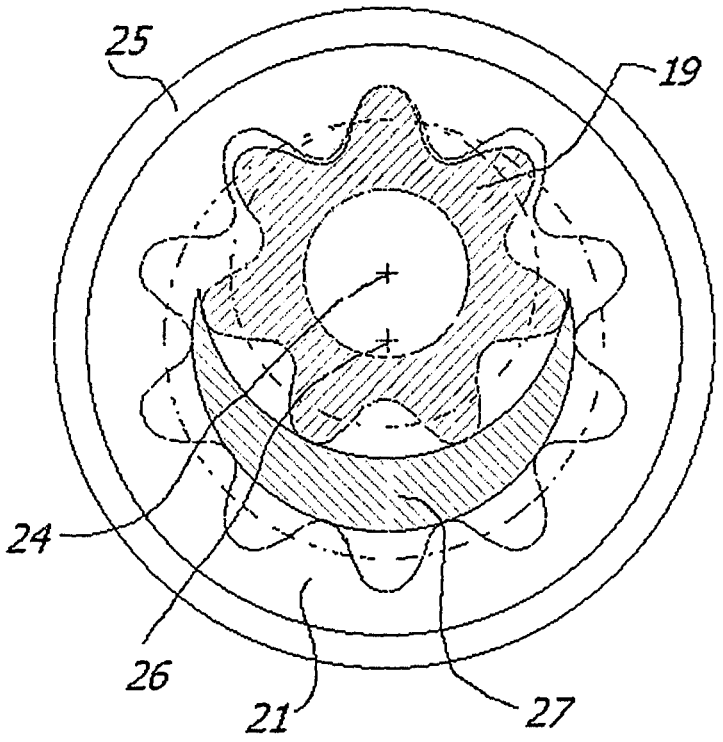
FIG. 5 is a diagrammatic view of FIG. 4 from left hand with internal toothing and a dividing lunette being cross-sectioned, in the specific case of a toothing with not encapsulating or semi-encapsulating profiles, that are valid also for external toothing.

As already illustrated the present invention is extended to the internal meshing. For example in FIG. 4 the external helical toothings 19,20 are positioned on the shaft 23 having its axis 24, and the internal toothed wheels 21, 22 meshing the external helical toothings 19,20, are positioned on a rotary element 25 rotatably supported by the housing 34 and having an axis 26. According to the present invention, one of the toothings 19,20,21,22 is idle. The separating lunette 27 (FIG. 5), as usually for the internal gear pumps, separate the suction port from the delivery port. The element 28 binds axially, with respect to the rotary element 25, the toothing 22 that, in the case of FIG. 4, is the idle one. Therefore, in case of internal toothing, said element 28 operates as the element 8 used for the external toothing, i.e. as a unilateral axial restraint. As seen, the constraining element 8 comprises at least one projection: in the case of the internal toothing the element 28 comprises at least a projection 31 that is correspondingly contained in a recessed surface 32 formed on the external face of the toothed wheel 22. It should be observed that the other unilateral axial constraining means in the external toothing is constituted by the support of the face 10 of the wheel of toothing 7 against the adjacent face of the wheel of toothing 6. In the same way the face 30 of the wheel of toothing 20 constitutes unilateral axial constraining means against the face adjacent to the wheel of toothing 19.

It should be observed that the exemplified distribution of two wheels blocked on the driving shaft and of an idle wheel and a blocked wheel on the rotary driven element is not binding, since the pump according to the invention can operate also with a blocked toothing and an idle toothing on the driving shaft.

Further, the shaft or rotary element generally on which the helical toothings are both blocked, can be made either by means of two coupled helical toothings or by means of only one double-helical toothing.

It should be appreciated that all the details can be replaced by other technically equivalent elements.

Practically, the used materials, provided that they are consistent with the specific use, as well as the dimensions and the shapes can be chosen from time to time according to the specific needs.

The invention claimed is:

1. A double-helical gear rotary positive displacement pump comprising a main pump housing rotatably supporting at least a driving shaft and at least a driven rotary element, the driving shaft being associated to at least a first double-helical toothing and the driven rotary element being associated to at least a second double-helical toothing meshing the first double-helical toothing which together constitutes four helical toothing portions, wherein only one of the four helical toothing portions is idle with respect to an axially adjacent one of the helical toothing portions, the idle helical toothing portion being constrained from moving axially, but allowed to rotate, by at least one axial constraining element acting between the idle helical toothing portion and the driven rotary element to which the idle helical toothing portion is mounted.

2. The pump according to claim 1, wherein the axial constraining element is fixedly connected to the driven rotary element on which the axial constraining element is positioned, the axial constraining element being positioned in contact with the idle toothing portion on a first face of the idle helical toothing porting opposed to a second face of the idle helical toothing porting, the second face being in contact with the axially adjacent one of the helical toothing portions.

3. The pump according to claim 2, wherein the axial constraining element includes a constraining element not extending to the entire circumference.

4. The pump according to claim 1, wherein the axial constraining element comprises a circular projection.

5. The pump according to claim 1, wherein the axial constraining element is contained, for liquid sealing purpose, in a recessed surface with a boundary line delimited radially by the toothed profile of the idle toothing portion.

6. The pump according to claim 5, wherein the boundary line and the toothed profile do not intersect, thus defining a continuous sealing surface for a liquid all around the circumference.

7. The pump according to claim 1, wherein the pump comprises a recessed surface on the face of the idle toothing portion for housing the axial constraining element.

8. The pump according to claim 1, wherein the pump comprises a recess for housing the axial constraining element on the side support of the shaft to which the second double-helical toothing is mounted.

9. The pump according to claim 1, wherein each double-helical toothing has a non-encapsulating kind profile being a so called continuous contact profile, or a semi-encapsulating profile.

* * * * *